US006213688B1

(12) United States Patent
Donkersloot, Sr.

(10) Patent No.: US 6,213,688 B1
(45) Date of Patent: Apr. 10, 2001

(54) EARTH RETAINING WALL

(76) Inventor: Arie Donkersloot, Sr., 8884 Estrella La., Apple Valley, CA (US) 92308

( * ) Notice: Subject to any disclaimer, the term of this patent is extended or adjusted under 35 U.S.C. 154(b) by 0 days.

(21) Appl. No.: 09/321,239

(22) Filed: May 27, 1999

(51) Int. Cl.[7] ..... E02D 27/40; E02D 29/02; E04C 2/06; F16C 11/04

(52) U.S. Cl. ..... 405/284; 405/286; 405/272; 52/608; 403/70

(58) Field of Search ..... 405/284, 285, 405/286, 282, 272, 273; 52/608–611; 403/24, 52, 62, 111, 119, 164, 68, 70

(56) References Cited

U.S. PATENT DOCUMENTS

| | | | | |
|---|---|---|---|---|
| 4,426,176 | | 1/1984 | Terada | 405/285 |
| 4,616,959 | | 10/1986 | Hilfiker | 405/285 |
| 4,874,272 | | 10/1989 | Egan | 405/284 |
| 5,127,770 | | 7/1992 | Ditcher et al. | 405/262 |
| 5,496,129 | * | 3/1996 | Dubé | 52/610 X |
| 5,890,334 | * | 4/1999 | Hughes, Jr. | 405/284 |
| 5,975,809 | * | 11/1999 | Taylor et al. | 405/284 X |
| 6,088,987 | * | 7/2000 | Simmons et al. | 52/608 X |
| 6,089,792 | * | 7/2000 | Khamis | 405/286 X |

OTHER PUBLICATIONS

Fintel, Mark, Handbook of Concrete Engineering, Second Edition, Van Nostrand Reinhold Co., New York, pp. 130–5, 1985.*

* cited by examiner

*Primary Examiner*—David Bagnell
*Assistant Examiner*—Tara L. Mayo
(74) *Attorney, Agent, or Firm*—Silverman, Cass & Singer, Ltd.

(57) ABSTRACT

An earth retaining wall formed by a plurality of panels which are matingly stacked together in jigsaw puzzle like fashion against an earth embankment. The panels are arranged one above another and are held together by vertical bars which pass through hollow pipes formed at peripheral portions of each panel. Each bar is formed at a terminal end with a ball foot formation which rests in a matingly engageable ball foot formation plate or footing positioned in the embankment. The upper terminal end of the wall is capped by a plate member. Wave breakers can be installed on the faces of the panels when the wall is employed as a sea wall. Two walls also can be installed in cooperative fashion to function as a water dam.

12 Claims, 5 Drawing Sheets

EARTH RETAINING WALL

BACKGROUND OF THE INVENTION

1. Field of the Invention

This invention relates generally to structures for retaining earth to prevent erosion or to function as a sea wall or dam, and more particularly, to such a structure which is formed of replaceable panels that are held in assembled condition using retaining bars that rest in a ball socket footing positioned in the earth.

2. Description of the Prior Art

Various forms of earth retaining structures or walls are known in the art to prevent erosion and/or to function as a sea wall or dam. Certain characteristics of such walls are desirable to enhance the structure and facilitate assembly and repair thereof.

For example, it is known to utilize a plurality of interconnecting panels to form such a retaining wall so that selected panels can be removed and repaired or replaced if they become damaged. Also, it is known to use reinforcing rods to facilitate support and connection of such panels when they are assembled as an earth retaining or sea wall.

Generally, the earth retaining or sea walls known in the art are positioned to rest on a foundation construction without any contemplation of, or provision for, movement of the wall with respect to the foundation. Such constructions have the disadvantage of possibly failing when the earth retained by the wall shifts during forces of nature such as earthquakes or slides, or the force of crashing water waves, thereby causing the wall to move off of the foundation and possibly collapse under the force of the earth or water.

The present invention provides an earth retaining wall which is positioned on a foundation footing with a mating ball and socket construction that permits the wall to flex or move at least a limited amount when the earth retained thereby shifts, but without resulting in the wall moving off of the foundation footing. Thereby, the earth retaining wall of the invention will not collapse and fail under the force of such earth movement, but continues to retain the earth as intended.

SUMMARY OF THE INVENTION

The invention is characterized by a wall formed of a plurality of panels which are matingly stacked together in Jigsaw puzzle like fashion against an earth embankment. The panels can be pre-formed concrete, or the like. The panels are arranged one above another and are held together by vertical bars which pass through hollow pipes or conduits formed in peripheral portions of each panel. Each bar is formed at a terminal end with a semicircular ball foot formation which rests in a matingly engageable ball socket foundation plate or footing positioned in the embankment. The upper terminal end of the assembled wall is capped by a concrete patio member or plate. Wave breakers can be installed on the faces of the panels when the wall is employed as a sea wall.

The earth retaining wall of the invention is advantageous in that it is somewhat flexible by reason of connections of adjacent panels along vertical bars. Such connections enable adjacent panels along the horizontal direction to move or flex one with respect to another as the retained earth moves in normal course. Also, the flexibility of the adjacent panel connections permits such panels to be assembled initially along an arc in the horizontal direction to form a water dam having generally convex configuration to resist the force of water pressure upstream of the dam. Further, the ball and socket interconnection of the wall with its foundation footing enables the wall to move somewhat in the vertical plane as the earth moves, but without the wall collapsing or crumbling when there is such earth movement.

The wall of the invention also has the advantageous characteristic in that it can be assembled from the top of an earth embankment by sliding panels down the vertical retaining bars and thereby the panels are stacked one above another, to the desired elevation of the wall. By reason of such assembly, panels which may become damaged after installation of the wall are separately replaceable by reversing the assembly procedure, thus obviating the need to replace the entire wall if a portion only becomes damaged.

Various objects and advantages of the invention will become apparent in accordance with the above and ensuing disclosure in which the preferred embodiments are described in detail in the specification and illustrated in the accompanying drawings. It is contemplated that minor variations may occur to the skilled artisan without departing from the scope or sacrificing any of the advantages of the invention.

DESCRIPTION OF THE PREFERRED EMBODIMENTS

Figure 1:
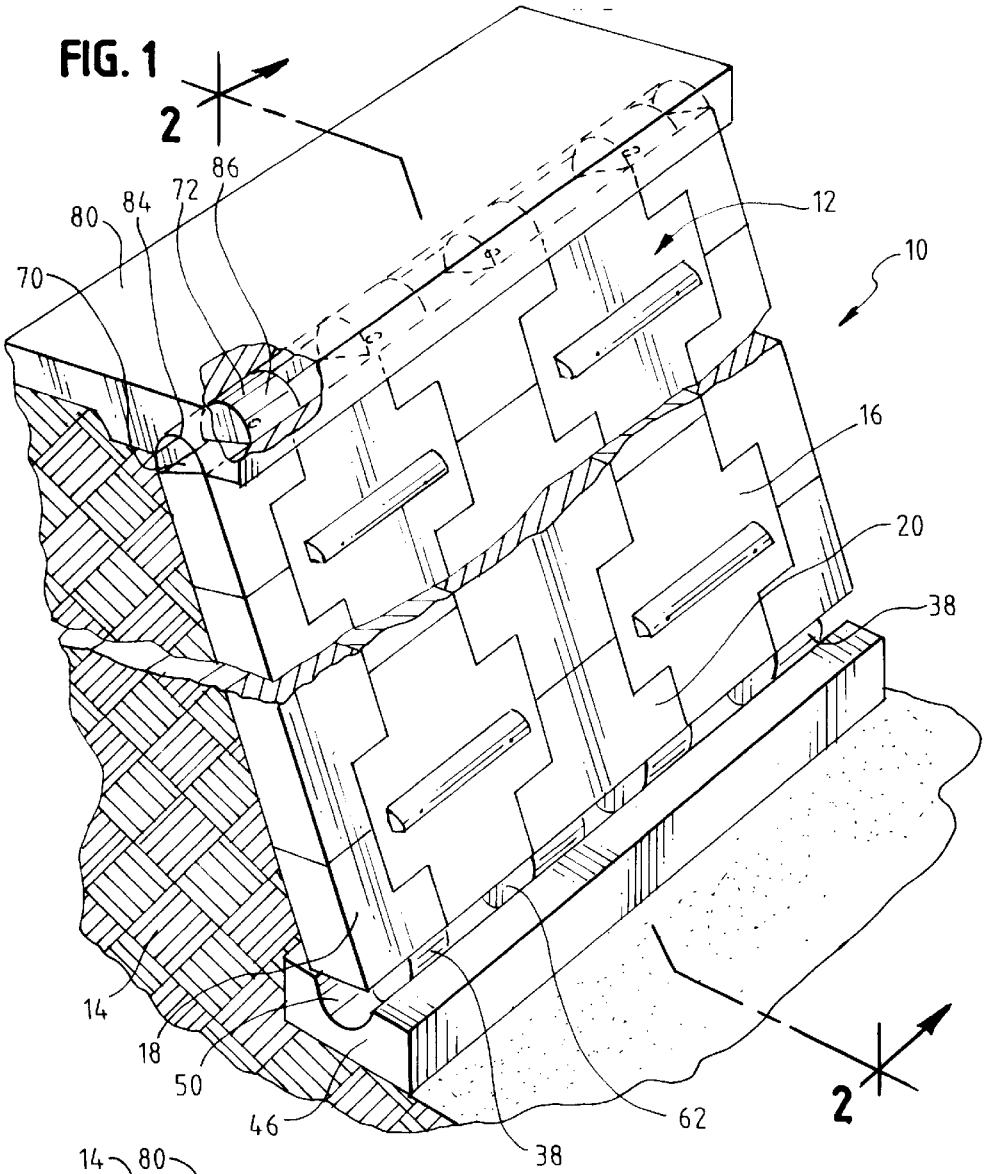
FIG. 1 is a perspective view of an earth retaining wall constructed in accordance with the invention, with portions thereof shown broken away and other portions shown in phantom outline to illustrate details of the invention.

Referring to FIGS. 1–14, the retaining wall 10 of the invention is formed of a plurality of assembled panels, indicated by the general reference numeral 12, which are matingly stacked or arranged together in jigsaw puzzle fashion against an earth embankment 14.

Panels 12 are pre-cast in one of three specific configurations: a generally cross-shaped mid-location panel 16, a generally L-shaped corner-location panel 18; and a generally T-shaped edge-location panel 20. Each panel 12 preferably is formed of concrete with reinforcing metal bars 22 in accordance with known techniques to form pre-cast concrete members. Tubular hollow pipes or conduits 24 are formed in portions of each panel 12 to facilitate assembly thereof in the manner described below. Cross-shaped panel 16 is formed with two such pipes 24A, 24B, one in each oppositely-disposed leg 26, 28; T-shaped panel 20 also is formed with two such pipes 24C, 24D, one in each oppositely disposed leg 30, 32; and L-shaped panel 18 is formed with one such pipe 24E in leg 34. Each of the pipes 24 opens to oppositely disposed edge surfaces of each panel 12 to provide passageways through said panels for receipt therethrough of bars 36 as described below. For example, pipe 24A of panel 16 opens at locations 17, 19 on edge surfaces 21, 23, and similarly for the other pipes formed in the other panels.

Figure 12:
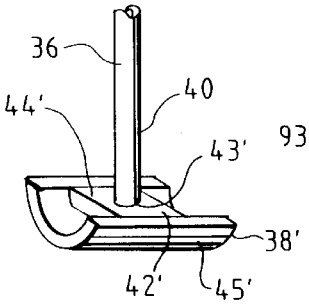
FIG. 12 is a view similar to that of FIG. 11 but illustrating an alternate construction of the semi-circular ball foot formation of the invention.
Figure 11:
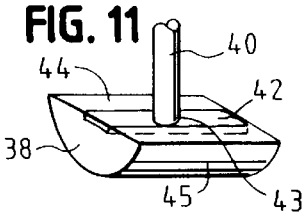
FIG. 11 is a fragmentary view of a vertical panel-retaining bar of the invention, showing the bottom semi-circular ball foot formation in position thereon, with constructional portions of the ball foot formation being shown in phantom outline.

A plurality of bars 36 are provided to retain panels 12 assembled together to form the retaining wall 10. Each bar 36 preferably is solid core metal of diameter dimension appropriate to pass through pipes 24 formed in panels 12. A ball foot formation 38 is provided for positioning at the lower terminal ends 40 of each bar 36. Each ball foot formation 38 preferably is formed of pre-cast concrete with a reinforcing plate 42 having a socket 43 for secure receipt therein of a terminal end 40 of a bar 36. Alternatively, as seen in FIG. 12, ball foot formation 38' is provided formed as a metal channel member with reinforcing plate 42' having a socket 43' for secure receipt of terminal end 40 of a bar 36. The cross-sectional configuration of each ball foot formation 38, 38' is generally semi-circular with a rounded support surface 45, 45' and a generally flat panel-resting surface 44, 44'.

A foundation or footing plate 46 is provided to support the ball foot formations 38. Plate 46 is formed of elongate configuration, preferably by pre-cast concrete with reinforcing bars 48, and has a channel 50 formed therein. The cross-sectional configuration of channel 50 is generally semi-circular to be cooperative with that of the ball foot formations 38 so that the support surface 45 of each ball foot formation can rest in the matingly engageable channel 50 of the footing plate 46.

The wall 10 is assemblable by matingly stacking panels 12 against earth embankment 14. First, footing plate 46 is positioned at the foot of the embankment. The length of plate 46 is pre-chosen in accordance with the desired length of the earth retaining wall. Alternatively, a plurality of plates 46 of various lengths can be arranged adjacent each other along the total length desired for the earth retaining wall.

Figure 3:
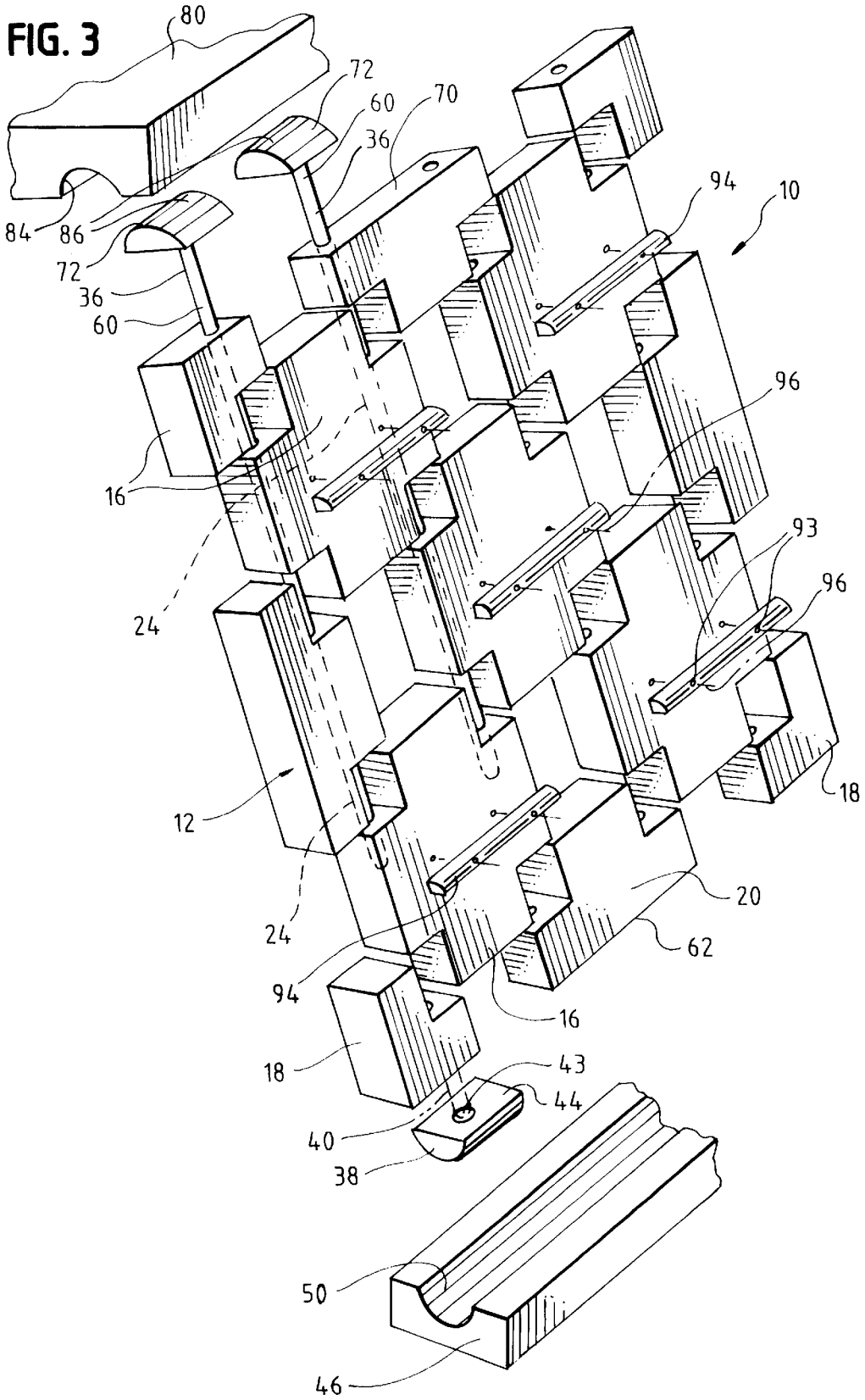
FIG. 3 is an exploded perspective view showing the manner of assembly of the various parts of the earth retaining wall of the invention.
Figure 4:
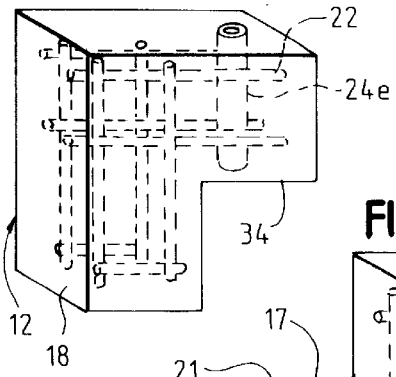
FIG. 4 is a perspective view of a corner panel used in assembly of the wall of the invention, which constructional features of said panel being shown in phantom outline.
Figure 5:
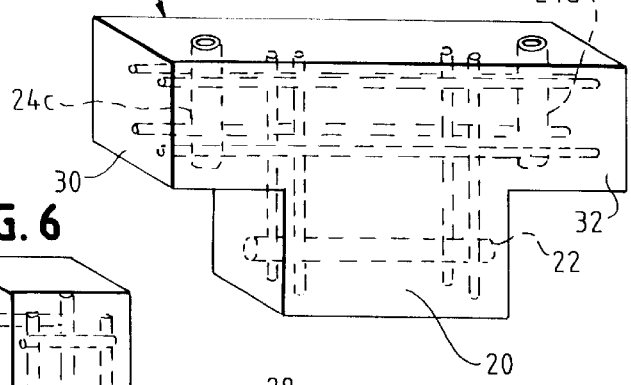
FIG. 5 is a perspective view similar to that of FIG. 4, but showing an end panel.
Figure 6:
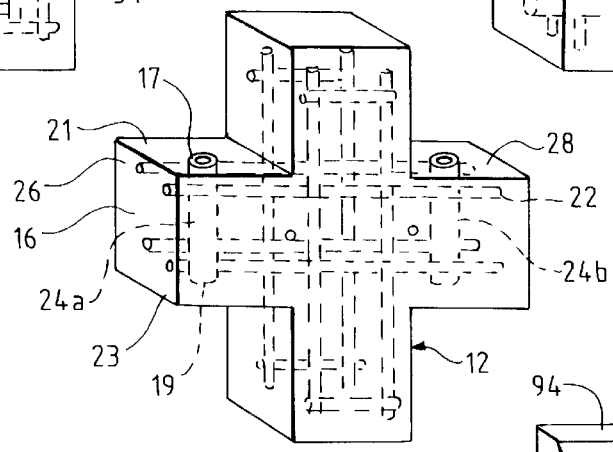
FIG. 6 is a perspective view similar to that of FIGS. 4 and 5, but showing a central panel.
Figure 7:
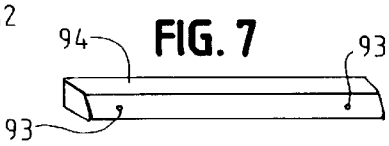
FIG. 7 is a perspective view of one embodiment of a wave breaker installed on the sea wall of the invention.
Figure 10:
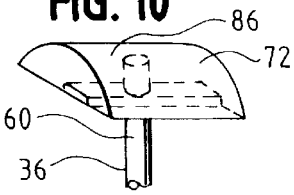
FIG. 10 is a fragmentary perspective view of a vertical panel-retaining bar of the invention, showing the top cap member in position thereon, with constructional portions of the cap member being shown in phantom outline.
Figure 8:
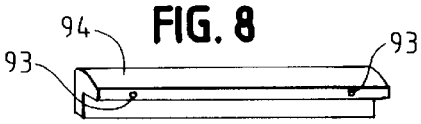
FIG. 8 is a perspective view of an alternate embodiment of a wave breaker.

Thereafter, a plurality of bars 36, each with a ball foot formation 38 secured to their terminal ends 40, is positioned spaced along the plate 46 with the ball foot formations resting within channel 50. Next, selected panels 12 are positioned at the tops 60 of the bars 36 with the bars passing through a selected pipe 24 in a panel 12. The lower or bottom edge 62 of wall 10 first is formed by positioning a corner panel 18 upon one bar, a mid-location panel 16 adjacent thereto on next positioned bars, and an edge-location panel 20 positioned adjacent to the last named panel on next positioned bars, continuing in this manner to the pre-chosen end of the wall where a last corner panel 18 is positioned on a last positioned bar 36. These panels are slid or moved down the bars which pass through the pipes 24 to rest against the flat panel-resting surfaces 44 of the ball foot formations 38. The remainder of the wall 10 is assemblable upon bars 36 in similar manner by positioning and stacking selected panels 12 one adjacent each other in jigsaw puzzle like fashion at the top of the bars 36 with the bars passing through pipes 24 and moving them down to rest upon the below-assembled panels. The openings of the pipes 24 on the edge surfaces of each panel 12 are in registry one with another when the panels are stacked one adjacent each other, as best seen in FIG. 3, so that the bars pass through all registered pipes of adjacently disposed panels 12. The weight of the assembled panels bears against the ball foot formations 38 to maintain their position within channel 50 of plate 46 and prevent the ball foot formations from leaving the channel.

Upon completion of assembly of wall 10 as described above, the uppermost edge 70 of the wall is capped off by installing upper ball formations 72 at the top terminal ends 60 of the bars 36. Upper ball formations 72 may be constructed the same as ball foot formations 38 with the same cross-sectional configurations. Next, the earth embankment 14 is levelled off at the top of wall 10, and a patio member or plate 80, preferably formed of concrete with reinforcing metal bars 82, and having a channel 84 which rests on the semi-circular surfaces 86 of upper ball formations 72 to secure the plate 80 in position.

Figure 2:
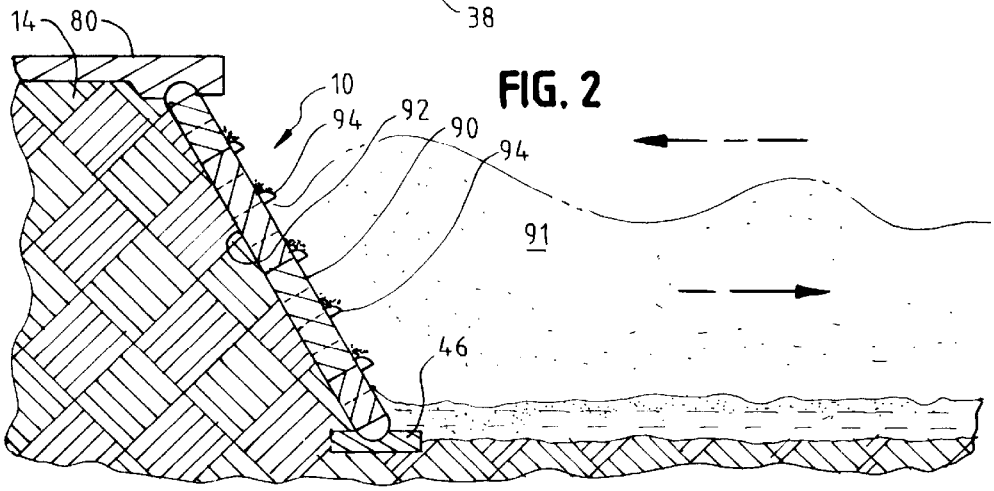
FIG. 2 is a sectional view taken along the line 2-2 of FIG. 1, in the direction indicated generally, with the wall shown installed as a sea wall.
Figure 9:
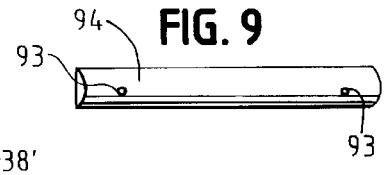
FIG. 9 is a perspective view of a third embodiment of a wave breaker.
Figure 13:
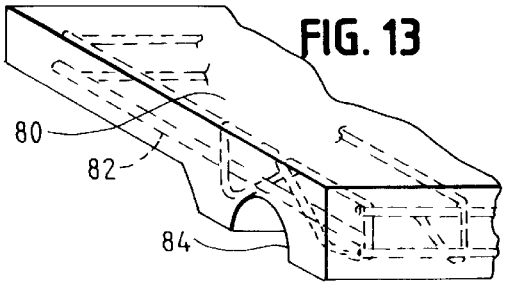
FIG. 13 is a fragmentary perspective view of the top patio member or plate installed on the wall of the invention, with constructional portions thereof being shown in phantom outline.
Figure 14:
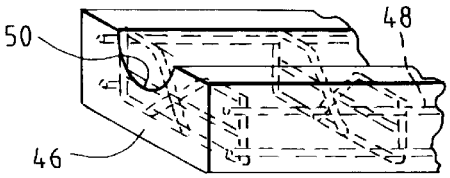
FIG. 14 is a fragmentary perspective view of the ball socket foundation plate or footing of the invention, with constructional portions thereof being shown in phantom outline.

The wall 10 can be installed to function as a sea wall, as illustrated in FIG. 2, with one side 90 of the wall facing water 91 and the opposite side 92 positioned against earth embankment 14. Wave breakers 94 can be positioned upon side 90 by anchors 96. Wave breakers 94 can be formed as pre-cast concrete members of generally elongate configuration with passageways 93 at opposite ends through which anchors 96 can be positioned for securement upon wall 10. The wave breakers 94 can be selected to be of generally rectangular configuration (FIG. 7), L-shaped cross-sectional configuration (FIG. 8), or semi-circular cross-sectional configuration (FIG. 9).

Once assembled, the earth retaining wall is somewhat flexible by reason of connections of adjacent panels 12 along vertical bars 36 passing through pipes 24. Such connections enable adjacent panels 12 along the horizontal direction to move or flex one with respect to another as the earth in embankment 14 moves in normal course. Further, the ball and socket interconnection between ball foot formations 38 which rest in channel 50 of plate 46 enables the wall to move somewhat in the vertical plane as the earth moves, but without the wall collapsing or crumbling when there is such earth movement.

The manner of assembly of wall 10 by separate panels 12 permits replacement of selected panels by reversing the assembly procedure, thus avoiding the need to replace the entire wall if a portion only becomes damaged.

Figure 15:
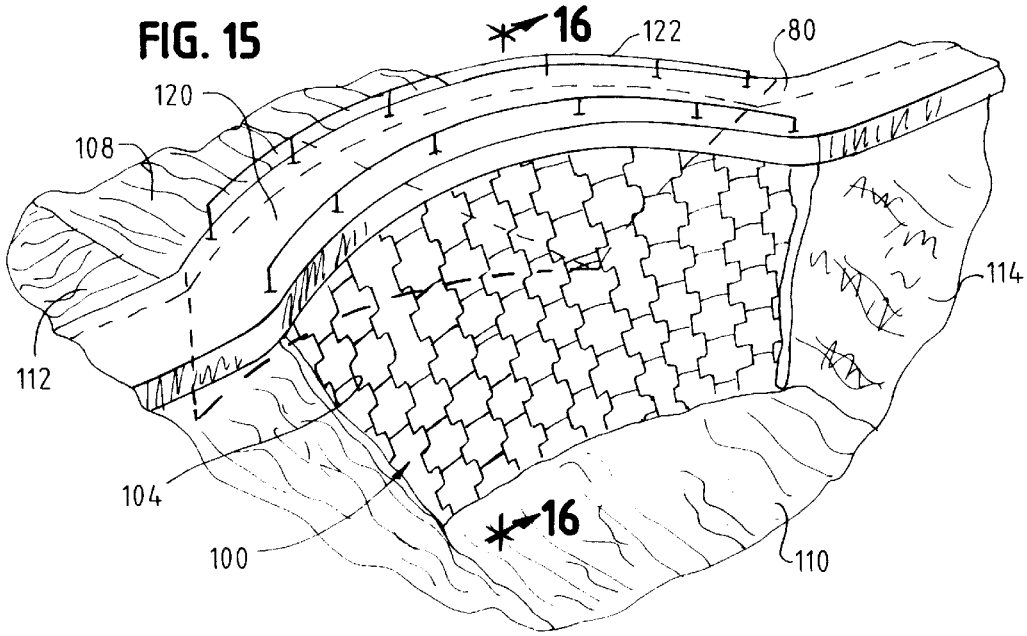
FIG. 15 is a perspective view of an alternate embodiment of the earth retaining wall of the invention, the same being shown with two such walls installed in cooperative fashion to function as a water dam.
Figure 16:
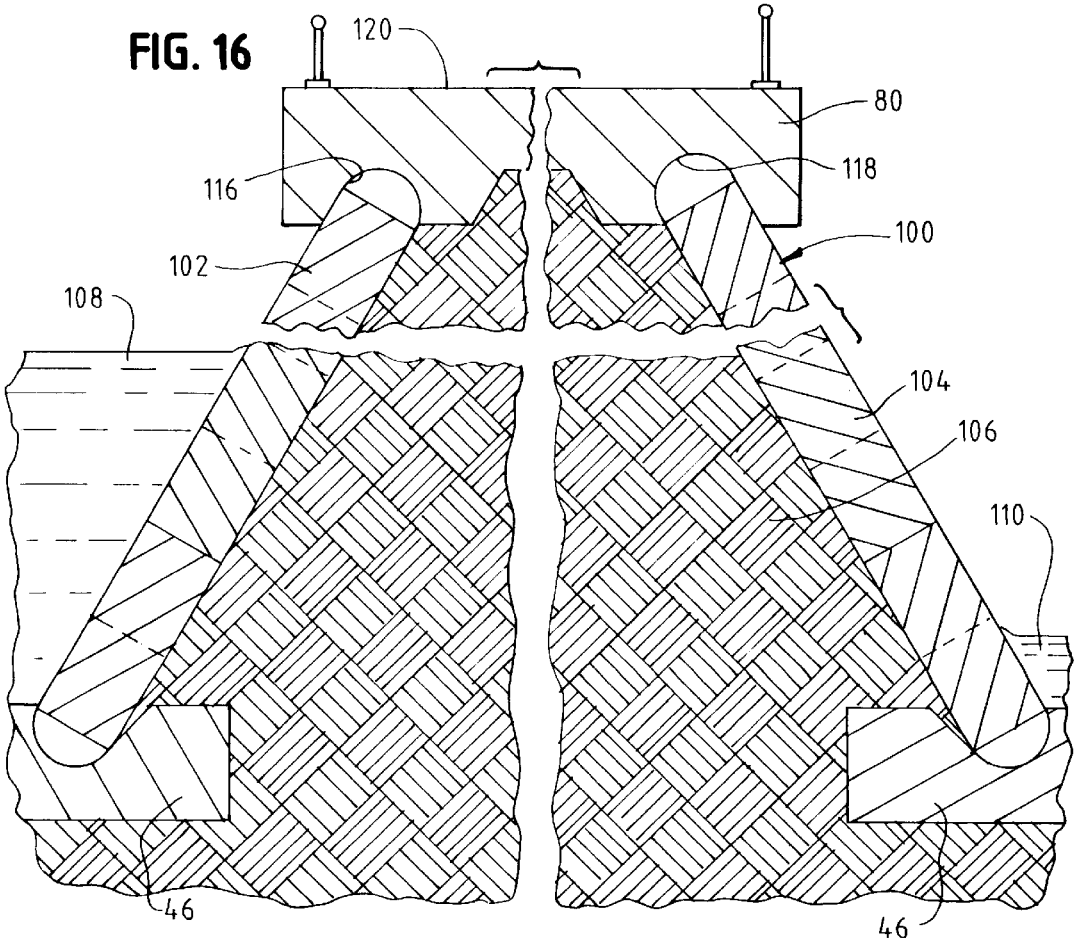
FIG. 16 is a fragmentary sectional view taken along the line 16–16 of FIG. 15, in the direction indicated generally.
Figure 17:
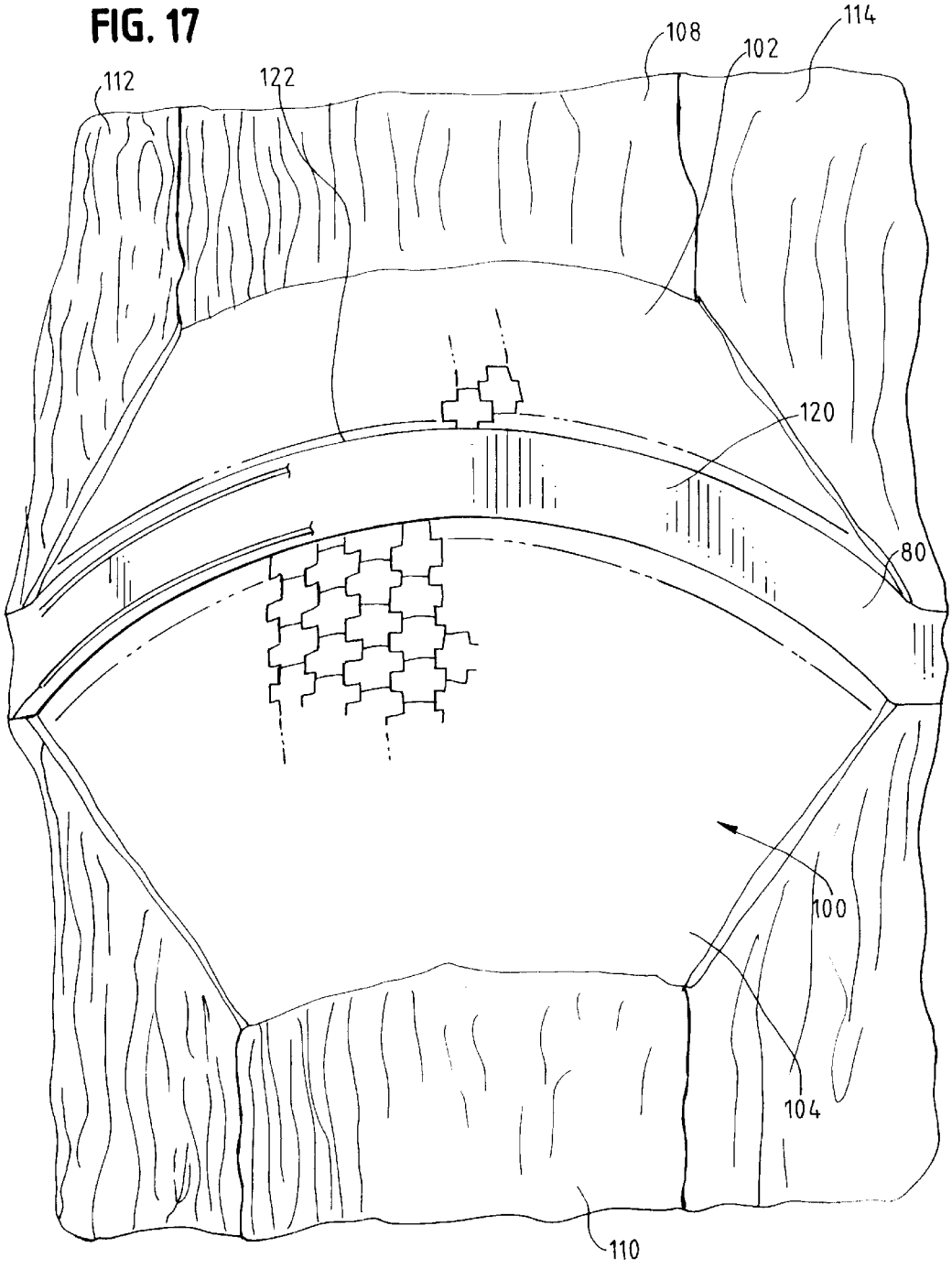
FIG. 17 is a top plan view of the embodiment shown in FIG. 15, with representative ones only of the panels thereof being shown.

Referring to FIGS. 15–17, an alternate embodiment of the retaining wall of the invention is shown installed as a water dam 100. Dam 100 is formed by assembling two retaining walls 102, 104 on opposite sides of an earth embankment 106. One wall 102 faces the pressure side 108 of a water channel, and the other wall 104 faces the low side 110 of the water channel. The walls 102, 104 of dam 100 are assembled in the same manner, and using the same constructional elements, as described hereinabove in connection with wall 10. The walls 102, 104 are positioned between earth walls 112, 114 in the water channel to close off the channel. Two plates 46 are used for dam 100, one each for the footings of walls 102 and 104. The top member or plate 80 has two channels 116, 118 to top off the upper ends of walls 102, 104, and can function as a roadway 120 at the top of the dam. The walls 102 and 104 are assembled with a generally convex configuration in the manner preferred to function as a dam. Such assembly is possible because of the flexibility of the adjacent panel connections as previously described, which permits the panels to be assembled along an arc 122 in the horizontal direction to form the dam having a generally convex configuration to resist the force of water pressure upstream (pressure side 108) of the dam.

Minor variations in the structure and other variations in the arrangement and size of the various parts may occur to those skilled in the art without departing from the spirit or circumventing the scope of the invention as set forth in the appended claims.

What is claimed is:

1. A wall for retaining an earth embankment, said wall comprising, a plurality of panels matingly stacked together to form said wall, said stacked panels adapted to be positioned against the embankment, each of said panels being formed with at least one hollow pipe passing therethrough and opening to oppositely disposed edge surfaces of respective ones of said panels, said panels being stacked one on top of another such that the openings of said pipes on the panel edge surfaces are in registry one with another, a plurality of bars positioned within said pipes and passing between said panels to hold said panels together, each bar having a lower terminal end, the lower terminal end of each bar being formed with a lower ball foot formation, a footing plate adapted to be positioned at the bottom of the embankment, said plate including a channel formed therein, the channel adapted to receive and retain the ball foot formation of each respective bar to maintain the wall in position against the embankment.

2. A wall as claimed in claim 1 in which said panels include at least one generally cross-shaped mid-location panel, a generally L-shaped corner location panel, and a generally T-shaped edge location panel.

3. A wall as claimed in claim 1 in which the panels and ball foot formations are formed of pre-cast concrete.

4. A wall as claimed in claim 1 in which the cross-sectional configuration of the ball foot formations and the channel formed in the footing plate is generally semi-circular.

5. A wall as claimed in claim 4 in which the ball foot formations include a rounded support surface and a generally flat panel-resting surface.

6. A wall as claimed in claim 5 in which the weight of the stacked assembled panels bears against the ball foot formations to maintain their position within said channel and prevent the ball foot formations from leaving the channel.

7. A wall as claimed in claim 1 in which each bar includes an upper terminal end, the upper terminal ends of said bars being formed with an upper ball formation.

8. A wall as claimed in claim 7 including a top plate positioned at the top of the embankment engaging said upper ball formations.

9. A wall as claimed in claim 1 including a plurality of water wave breakers installed on one surface of said wall.

10. A wall as claimed in claim 1, wherein said wall is a first wall and further including a second said wall adapted to be positioned adjacent to the earth embankment on a side opposite the side of the embankment against which said first wall is positioned, said first and second walls forming a dam for a water channel blocked by the embankment.

11. A wall as claimed in claim 10 in which the walls are assembled with a generally convex configuration with respect to the pressure side of said water channel.

12. A wall as claimed in claim 11 in which each bar includes an upper terminal and, a top plate positioned at the top of said embankment engaging said upper terminal ends of the bars, said top plate having a roadway surface thereon.

* * * * *